US006223451B1

(12) United States Patent
Satake et al.

(10) Patent No.: US 6,223,451 B1
(45) Date of Patent: May 1, 2001

(54) APPARATUS FOR DRYING GRANULAR OBJECTS INVOLVING PRE-HEATING PROCESS

(75) Inventors: Satoru Satake, Tokyo; Hou Qing Liu, Hiroshima; Makoto Kuninobu, Hiroshima; Keisuke Orihashi, Hiroshima, all of (JP)

(73) Assignee: Satake Corporation, Tokyo (JP)

( * ) Notice: Subject to any disclaimer, the term of this patent is extended or adjusted under 35 U.S.C. 154(b) by 0 days.

(21) Appl. No.: 09/474,761

(22) Filed: Dec. 30, 1999

(30) Foreign Application Priority Data

Jan. 13, 1999 (JP) ..... 11-006465
Mar. 1, 1999 (JP) ..... 11-053339

(51) Int. Cl.[7] ..... F26B 11/02
(52) U.S. Cl. ..... 34/134; 34/168; 34/177
(58) Field of Search ..... 34/72, 79, 134, 34/138, 167, 168, 175, 176, 177

(56) References Cited

U.S. PATENT DOCUMENTS 3,742,614 * 7/1973 Betterman et al. ..... 34/164 X
4,032,305 * 6/1977 Squires ..... 48/73
4,686,779 * 8/1987 Wyatt et al. ..... 34/168
4,784,216 * 11/1988 Bracegirdle et al. ..... 165/64
5,052,123 * 10/1991 Tischendorf et al. ..... 34/168 X
5,305,533 * 4/1994 Alexander et al. ..... 34/108 X
5,685,434 * 11/1997 Ackerman ..... 34/168 X

FOREIGN PATENT DOCUMENTS 58-187779 11/1983 (JP) .
60-8434 3/1985 (JP) .
62-9174 1/1987 (JP) .
2789279 6/1998 (JP) .

* cited by examiner

*Primary Examiner*—Stephen Gravini
(74) *Attorney, Agent, or Firm*—Fish & Richardson, PC

(57) ABSTRACT

An apparatus for drying granular objects comprises, from the top of the apparatus, a holding section; a heating section for heating the granular objects flowing down from the holding section, the heating section being provided beneath the holding section and having a plurality of air ducts to which heated air is introduced; a drying air producing section connected to the air ducts, in which the heated air from the air ducts is mixed with air taken-in from the outside of the apparatus to produce a drying air; and a drying section for drying the granular objects by directly exposing the granular objects to the drying air. The dried granular objects are taken out from a taking-out section and returned to the holding section through a bucket elevator. The apparatus further comprises a detector for detecting the temperature of the drying air. Based on the detected temperature, a control device controls the temperature of the heated air so as to keep the temperature of the drying air to a predetermined temperature. The temperature of the drying air can be set to a desirable temperature while the heated air for the heating is kept at a high temperature. The drying operation is performed speedily and safely.

6 Claims, 11 Drawing Sheets

APPARATUS FOR DRYING GRANULAR OBJECTS INVOLVING PRE-HEATING PROCESS

BACKGROUND OF THE INVENTION (1) Field of the Invention

The present invention relates to a method and an apparatus for drying granular objects in which the granular objects are dried by being exposed to drying air, and more particularly to a method and an apparatus for drying granular objects which utilize a structure for elevating the temperature of granular objects in advance to their exposure to the drying air.

(2) Description of the Related Art

As a conventional method for drying granular objects by exposing them to drying air, a common method was one in which a high temperature drying air was produced by a burner and a fan and the granular objects were repeatedly exposed to such drying air. However, for purposes of reducing the drying time and of preventing the quality change of the granular objects caused during the drying, a method involving pre-heating process of the granular objects, that is, a method with which the internal temperature of the granular objects is raised in advance before they are exposed to the drying air, has attracted attention as an improved method. One example of a drying apparatus which utilizes far infrared radiation for purposes of the pre-heating is found in Japanese Patent Publication No. 2789279.

The drying method and apparatus equipped with the far infrared radiation means disclosed in the above patent publication seemingly has achieved as far as the above objects are concerned. However, since the structure is such that the far infrared radiation generator should be installed within the drying chamber, the size of the apparatus inevitably became larger by the installation space of the far infrared radiation generator, and thus the apparatus itself unavoidably became large-sized. That is, basically, in order to obtain the effects of radiant heat by providing the far infrared radiation generator within the drying apparatus, it is obvious that a correspondingly large space is required. Since the recent trend of the drying apparatus has been to make its size small and the improvement has been underway by reducing the drying chamber for exposing drying air to grains, the introduction of a far infrared radiation generator is against the trend of reducing the entire size of the drying apparatus.

Conventional methods with which granular objects are pre-heated without utilizing a far infrared radiation generator have been disclosed in Japanese Patent Application Kokai Publication No. Sho 58-187779, Japanese Patent Application Kokoku Publication No. Sho 60-8434, Japanese Patent Application Kokai Publication No. Sho 62-9174, etc. The technique disclosed in each of Patent Application Kokai Publication No. Sho 58-187779 and Patent Application Kokoku Publication No. Sho 60-8434 relates to an arrangement in which a heated air path and a drying chamber are provided with separate heat sources, respectively. Because of this arrangement, these separate heat sources are required to be separately controlled. With use of a plurality of heat sources and need of controlling them separately, the apparatus will inevitably be costly.

Further, the technique disclosed in Patent Application Kokai Publication No. Sho 62-9174 relates to a system in which the heated air produced by a burner and sucked by an air exhausting means is supplied directly to a heated air path chamber thus enabling to pre-heat the grains, and the heated air is supplied from the heated air path chamber to a drying chamber through a heated air guide path. In this system, not only is it made possible to produce both the heated air and the drying air by one heat source (one burner), but also it is made possible to pre-heat the grains immediately below a tank chamber, so that an advantage in this system over the above described drying apparatus, of U.S. Pat. No. 2,789,279 is that, unlike said apparatus, the system does not become large-sized.

However, as to the temperature control in the above system, the drying air temperature (approximately 40° C.) in the drying chamber at which grains are dried should be made as a reference temperature and, since the heated air path chamber communicates to the drying chamber simply through the heated air guide path, even by taking into account the fact that the temperature of the heated air drops due to a heat loss to occur at the heated air guide path, the temperature of the heated air never drops to the extent that it is suitable for drying the granular objects and, thus, it is necessary that the temperature of the heated air itself generated by the heat source of the burner must be substantially lowered. As a result, it will be impossible to raise the temperature of the air at the heated air path chamber, which is to raise the temperature of grains by being in contact with the grains, to the extent sufficient to contribute to the pre-heating.

It has become evident that, in drying granular objects, it is essential, for safely and speedily drying the granular objects, to pre-heat the granular objects and to maintain the predetermined temperature of the granular objects themselves prior to the exposure to drying air and, toward this end, various technical researches and developments have been made but so far without success. The object of the present invention is to provide a drying method and an apparatus which enable to meet the demand for a small-sized drying apparatus, and to achieving a desired drying air temperature with a high pre-heated temperature being maintained, thereby enabling the provision and manufacture of low cost drying method and apparatus with which it is possible to conduct the drying of granular objects safely and speedily.

SUMMARY OF THE INVENTION

According to one aspect of the present invention, there is provided a method for drying granular objects until their water content reaches a predetermined water content value, the method comprising the steps of:

holding the granular objects;

pre-heating the granular objects flowing down through the holding step by causing the granular objects to be in contact with outside walls of air ducts into which heated air is introduced;

producing drying air by mixing the heated air from the air ducts with air taken-in from the outside;

drying the granular objects with their water content being taken away, the granular objects flowing down after having been pre-heated by the pre-heating step, by directly exposing the granular objects to the drying air; and taking out the granular objects flowing down after having been dried by the drying step.

According to another aspect of the invention, there is also provided an apparatus for drying granular objects until their water content reaches a predetermined water content value, the apparatus comprising:

a holding means for holding therein the granular objects;

a heated air generating means for generating a heated air;

a pre-heating means for heating the granular objects flowing down from the holding means, the pre-heating means being provided beneath the holding means and having a plurality of air ducts horizontally arranged therein, the heated air generated by the heated air generating means being introduced to each of one ends of the plurality of air ducts;

a drying air producing means connected to the other ends of the plurality of air ducts, in which the heated air from the air ducts is mixed with air taken-in from the outside of the apparatus so as to produce a drying air;

a drying means for drying the granular objects by directly exposing the granular objects to the drying air, the drying means having a drying chamber to which the granular objects after having been pre-heated at the pre-heating means are supplied and to one end of which the drying air produced by the drying air producing means is introduced;

an exhausting means connected to the other end of the drying chamber of the drying means, for exhausting the drying air involving humidity to the outside of the apparatus; and a taking-out means arranged beneath the drying means, for taking out the dried granular objects.

For drying the granular objects, as there is provided the heating process between the holding process and the drying process, the temperature from the center portion to the surface portion within the grain can be made uniform and, thus, distortion hardly occurs in the granular objects when they are exposed to the heated air for drying. As a result, not only it is possible to reduce damages of the granular objects caused by the drying, but also it is possible to make the drying more speedily. Further, since it is possible to introduce into the drying process, as a drying air, a heated air whose temperature has been lowered by mixing the outside air to the heated air forwarded from the heating process, even if the temperature of the heated air at the heating process is comparatively high, the heated air can be sufficiently lowered in its temperature by the introduction of the outside air to the extent that it is suitable for the drying operation. Further, the above heating process can be provided at the holding process, no additional space for installing the heating process is necessary, thereby realizing a compact size apparatus.

For the purpose of maintaining the temperature of the drying air at a predetermined one, there is provided means for detecting a temperature of the drying process and, for controlling, based on the detected temperature, the temperature of the heated air at the heating process. With this construction, when the heated air is converted to the drying air suitable for the drying with the outside air being taken-in, even if there occurs any changes in the external conditions such as the rising of the circumference temperature of the apparatus, which may cause the drying air temperature high otherwise, it is possible to keep the drying air to a stable temperature by the control of the temperature of the heated air itself.

In the heating process, a part of the heated air is introduced into the granular objects that are falling down, and the granular objects are exposed to the heated air. In this way, the raising of the temperature of the granular objects to an appropriate temperature is further accelerated, so that the temperature of the granular objects are raised from the starting stage of the drying and the drying speed is advanced. Further, since the heated air is applied to the granular objects at the heating process in addition at the drying process, the positive heating by the heating process in addition to the drying by the conventional drying process, the drying process consisting of the heating process and the drying process can be carried out with high efficiency. In this way, without enlarging the size of the drying apparatus, the drying efficiency is in substance elevated, thus meeting the demand and trend of a smaller sized apparatus.

The above explained drying process in which a part of the heated air is introduced into the flow of the flowing down granular objects includes an outside air adjusting means for increasing or decreasing the amount of in-taking outside air so that the amount of the heated air to be introduced into the granular objects may be changed. Specifically, when the amount of outside air is changed to be reduced by the adjustment of the outside air adjusting means, the amount of the shortage of the air corresponding to the decrease in the amount of the introduced outside air is compensated by the increase in the amount of a part of the heated air introduced into the granular objects in the heating process. This means that the amount of a part of the heated air introduced into the granular objects increases inversely with the decrease in the amount of introduced outside air. Because of this, the heated air introduced into the granular objects during the heating process increases and, accordingly, the temperature of the granular objects subjected to the heating process is raised faster. In order to carry out this more effectively, it is preferable that this process is performed only during the initial stage of the drying, for example, only during the period in which the granular object filled up are heated up through one cycle of all the processes from the heating process to the taking out process. By so doing, the temperature of the entire granular objects can be elevated more quickly to the temperature suitable for the fast drying and, thereafter, by starting the introduction of the outside air in an ordinary way or a steady state, it is possible to dry the entire granular objects more speedily.

BRIEF DESCRIPTION OF THE DRAWINGS

The above and other objects, features and advantages of the present invention will be apparent from the following description of preferred embodiments of the invention explained with reference to the accompanying drawings, in which.

PREFERRED EMBODIMENTS OF THE INVENTION

Figure 1:
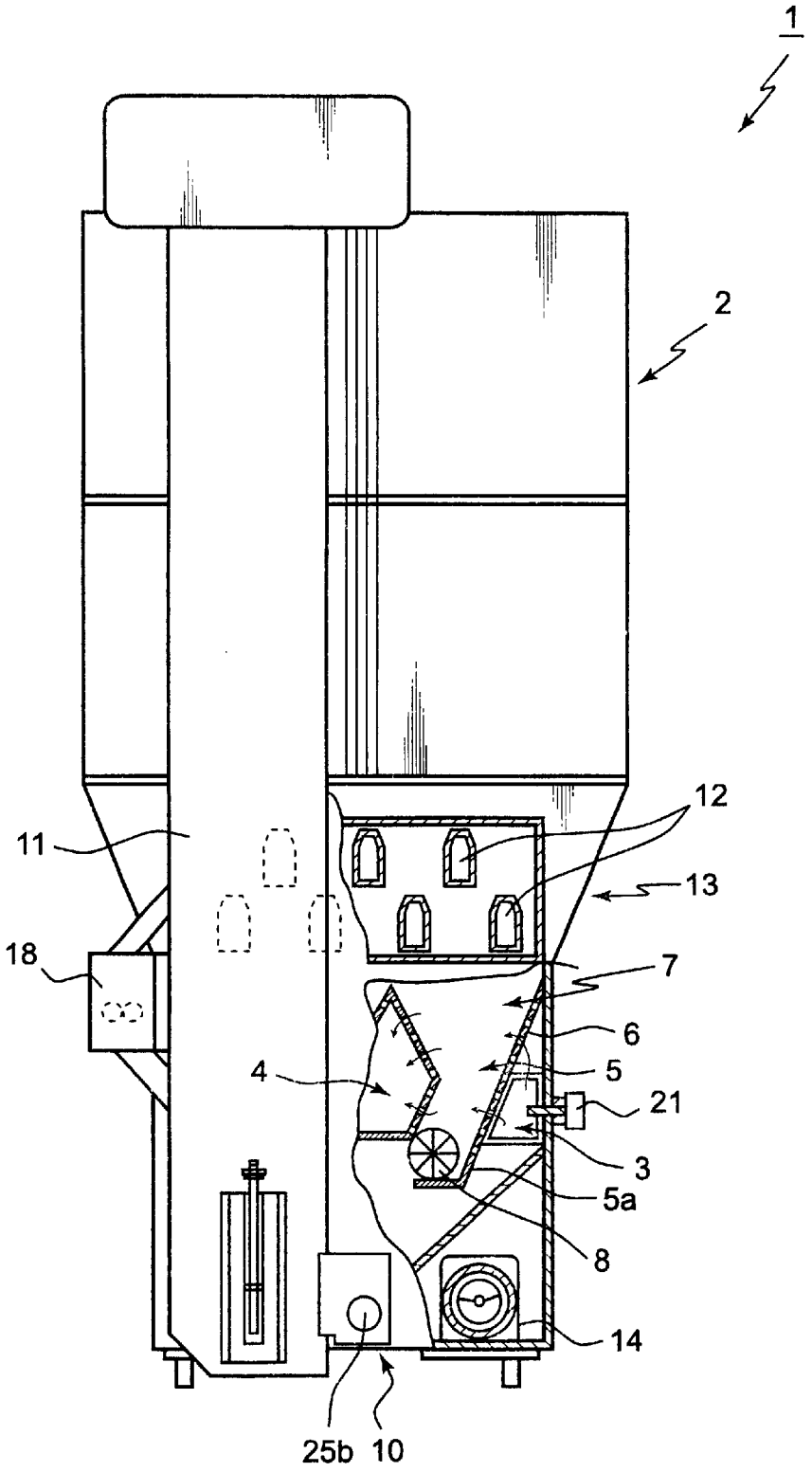
FIG. 1 is a front view, partly in broken away, of a circulating type grain drying apparatus according to the present invention.
Figure 2:
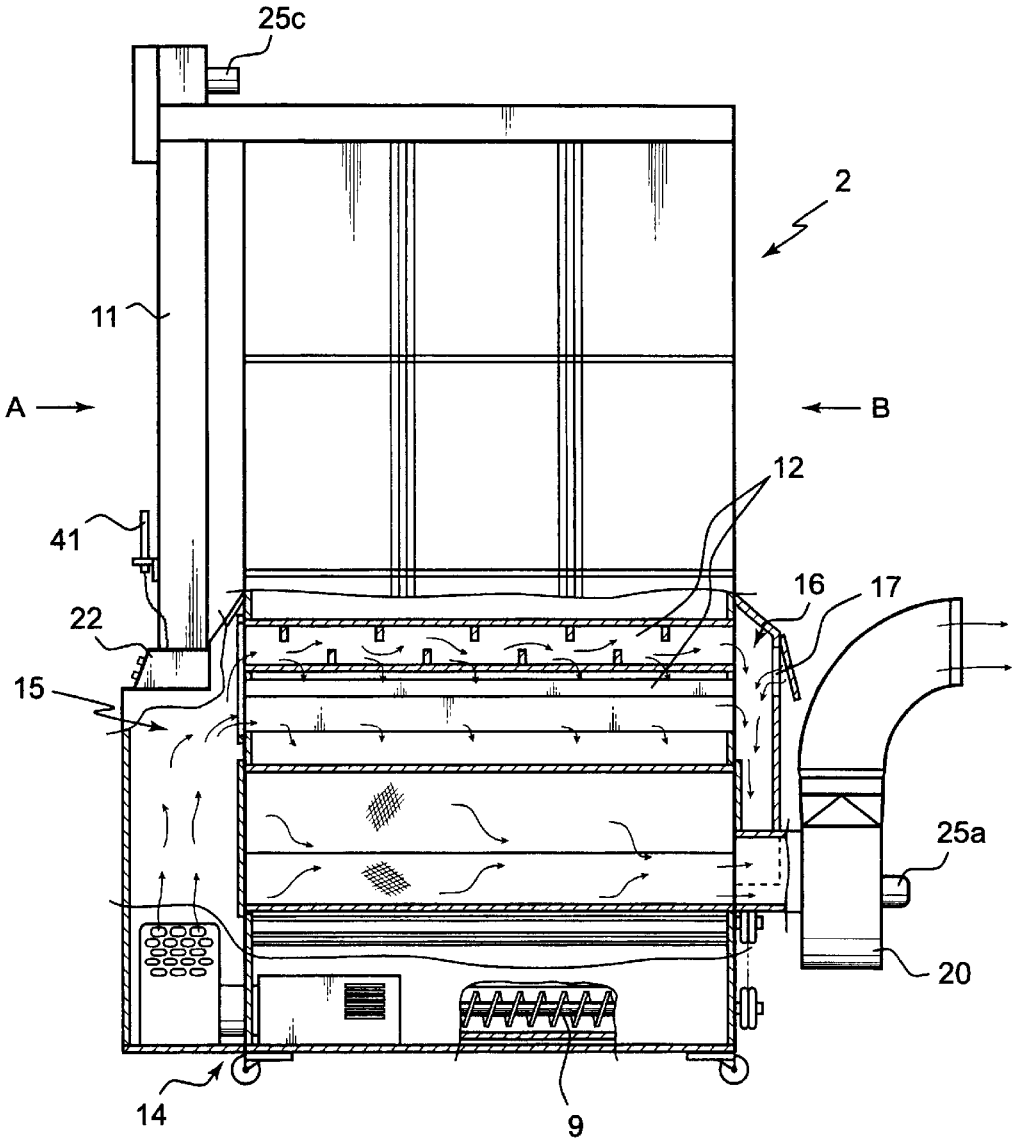
FIG. 2 is a side view, partly in broken away, of the circulating type grain drying apparatus according to the present invention.
Figure 3:
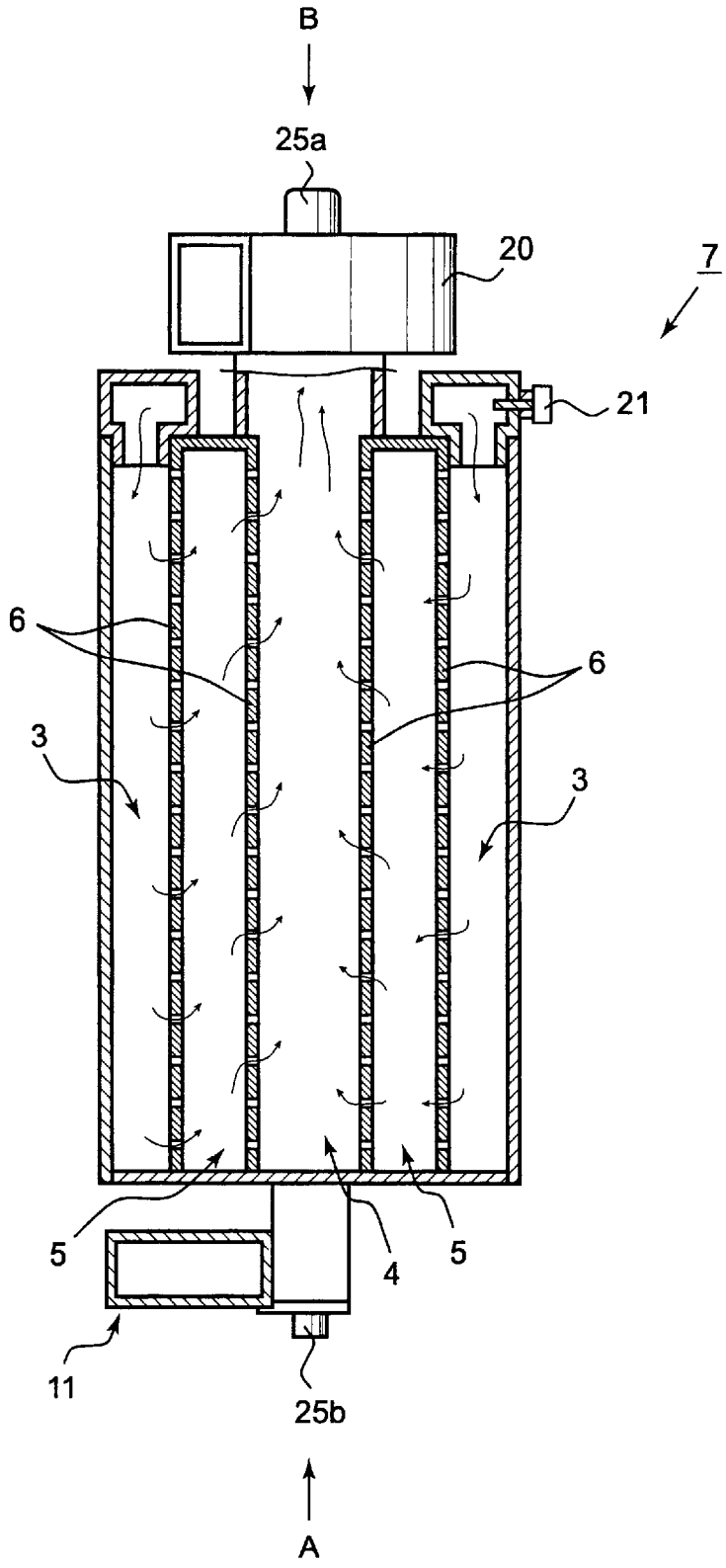
FIG. 3 is a plain sectional view of the drying chamber of the circulating type grain drying apparatus according to the present invention.

Now, a preferred embodiment of the invention is explained with reference to FIGS. 1 to 4. Here, the explanation is made on one example of a circulating type grain drying apparatus for drying grains as granular objects. A grain drying apparatus 1 is provided with, starting sequentially from the top thereof, a holding tank 2 for holding the grains to be subjected to the drying; a drying chamber 7 having air paths 3, an air exhaust path 4 and grain flow tubes 5 connected to the holding tank 2, which are divided by perforated plates 6 extending from a front side A to a rear side B; and a taking-out section 10 from which the dried grains are taken out thereat. The taking-out section 10 includes a rotary valve 8 for intermittently exhausting the grains flowing down on the non-porous slanted plates 5*a* connected to the perforated plates 6 of the drying chamber 7, and a screw-conveyor 9 for laterally feeding the grains fed from the rotary valve 8. Further, the taking-out section 10 and the holding tank 2 are connected by a bucket elevator 11. As a result, a circulating operation is repeated such that the grains forwarded to the drying chamber 7 from the holding tank 2 are again introduced into the holding tank 2 by the bucket elevator 11 via the taking out-section 10.

The holding tank 2 is equipped with a heating section 13 which is formed under the holding tank 2 and having a plurality of air ducts 12 extending in the front to the rear direction. At the front side A of the drying chamber 7 of the grain drying apparatus 1, a burner means 14 using a lamp oil as fuel is provided, and a heat path via the front air path 15 is provided so that the heat generated by the burner means 14 is directly introduced as heated air to the starting ends (at the front side A) of the plurality of the air ducts 12. The finishing ends (at the rear side B) of the air ducts 12 are connected to the air paths 3 of the drying chamber 7 through a rear air path 16. The rear air path 16 is provided with an outside air in-take opening 17. At the rear side B of the grain drying apparatus 1, there is provided an exhausting fan 20 whose air passage is connected to the air exhaust path 4. At the connecting portion between the rear air path 16 and the drying chamber 7, there is provided a temperature sensor 21 for measuring the temperature of the drying air. This sensor 21 is connected to the burner means 14 through a control means 22. In this illustrated example of arrangement, the air ducts 12 are laterally disposed in the front to rear direction. However, the arrangement is not limited to this example as the air ducts 12 may be in the left to right direction, or the heating section 13 may be formed by combining the arrangements in the front to rear direction and the left to right direction.

Figure 4:
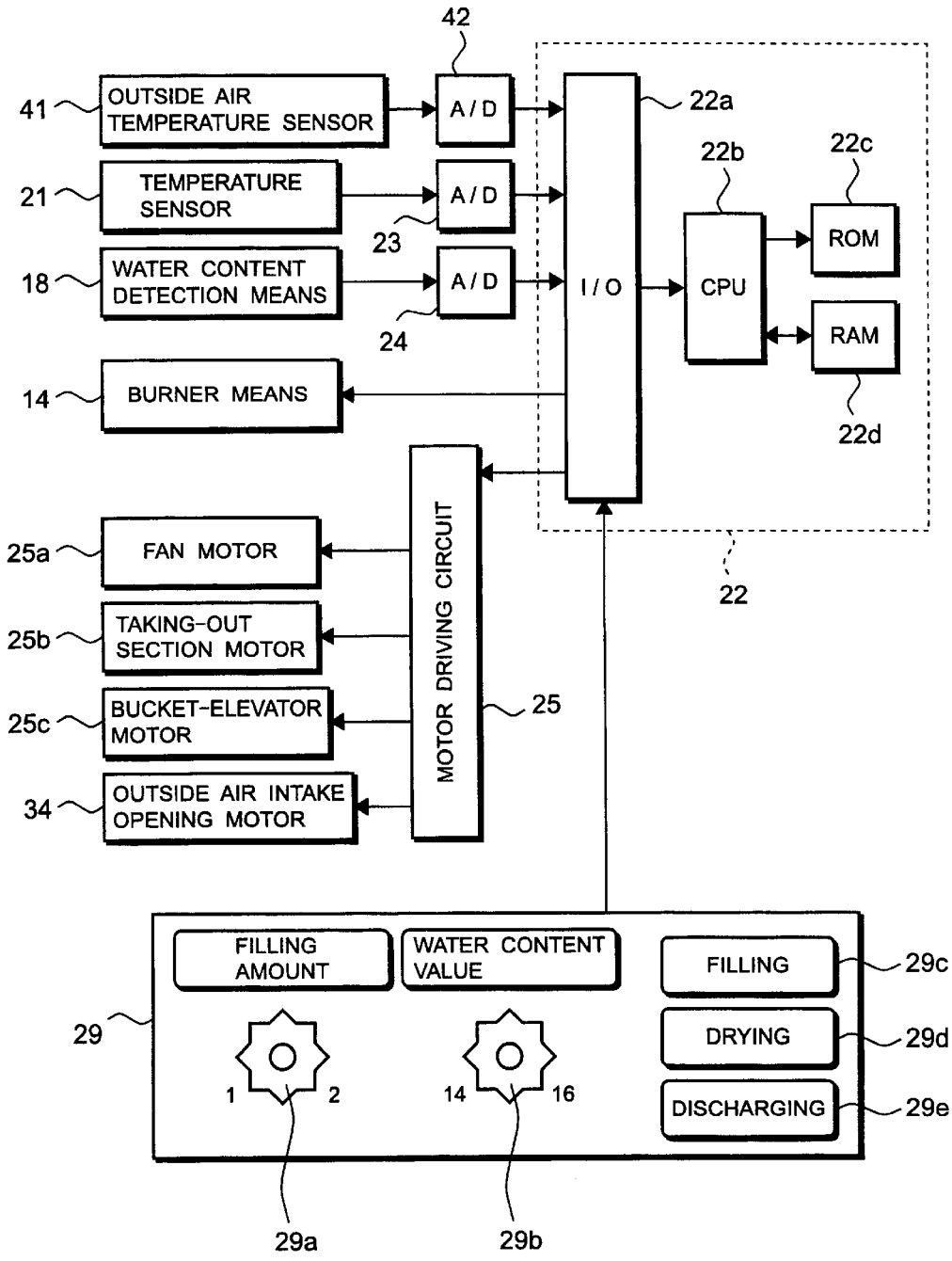
FIG. 4 is a control block diagram of the grain drying apparatus according to the present invention.

FIG. 4 is a control block diagram of the control means 22. The burner means 14 is controlled by the control means 22 such that the drying air introduced into the drying chamber 7 is controlled so as to be a predetermined temperature (approximately 40° C.). To the I/O port 22*a* of the control section 22, there are respectively inputted signals from an input section 29 equipped with various operating switches, a signal from the temperature sensor 21 for the drying air via an A/D conversion circuit 23, a signal from a water content detection means 18 via an A/D converter 24, and a signal from an outside air temperature sensor 41 via an A/D conversion circuit 42. Also, from the I/O port 22*a,* signals are outputted to the burner means 14 and the motor driving circuit 25, respectively. The motor driving circuit 25 operates to start and/or stop a driving motor 25*b* of the taking-out section 10, a driving motor 25*c* of the bucket elevator 11, a driving motor 25*a* of the air exhausting fan 20, and a motor 34 for the outside air intake opening. The control means 22 is equipped with an CPU 22*b,* as a main element, for performing the comparison and calculation operation. The control means 22 is further equipped with the I/O port 22*a,* a read-only-memory (here-inafter referred to as "ROM") 22*c* in which control programs and set values of temperatures and/or water content values are stored, and a random-access-memory (hereinafter referred to as "RAM") 22*d* in which filling up amount and selected values inputted from the input section 29, and the results of the calculation are stored. These I/O port 22*a,* ROM 22*c* and RAM 22*d* are all connected to the CPU 22*b*. The CPU 22*b* monitors the respective signals from the input section 29, the temperature sensor 21, the water content detection means 18 and the outside air temperature sensor 41, and outputs control signals, based on the respective signals from the input section 29, to various sections and means so that the corresponding sections and means operate accordingly.

The input section 29 is equipped with a filling setting switch 29*a* for setting the amount of filling of the grains, a water content setting switch 29*b* for setting the target value of water content at the finishing, a filling button 29*c* for starting the filling up operation, a drying button 29*d* for starting the drying operation, a discharging button 29*e* for discharging grains, etc. Upon receiving the signal generated by operating the filling button 29*c* from the input section 29, the control means 22 sends out a control signal to the motor driving circuit 25 so as to drive the taking-out section motor 25*b,* the bucket-elevator motor 25*c* and the fan motor 25*a*. Also, upon receiving the signal generated by operating the discharge button 29*e* from the input section 29, the control means 22 sends out a control signal to the motor driving circuit 25 so as to drive the bucket-elevator motor 25*c,* the taking-out section motor 25*b* and the fan motor 25*a*.

In carrying out the actual drying operation, first the amount of filling in the holding tank 2 is set by the filling setting switch 29*a* and the target water content value at the finishing is set by the water content setting switch 29*b*. These values are stored in the RAM 22*d* and, thereafter, the drying starting switch 29*d* is switched on. When the control means 22 receives the drying starting signal, it sends out a control signal to the motor driving circuit 25 so that the taking-out section motor 25*b,* the bucket-elevator motor 25*c* and the fan motor 25*a* are respectively driven in accordance with the programs stored in the ROM 22*c,* and it also sends out a burning signal to the burner means 14. Then, the programs given hereunder with reference to FIG. 5 are followed.

Figure 5:
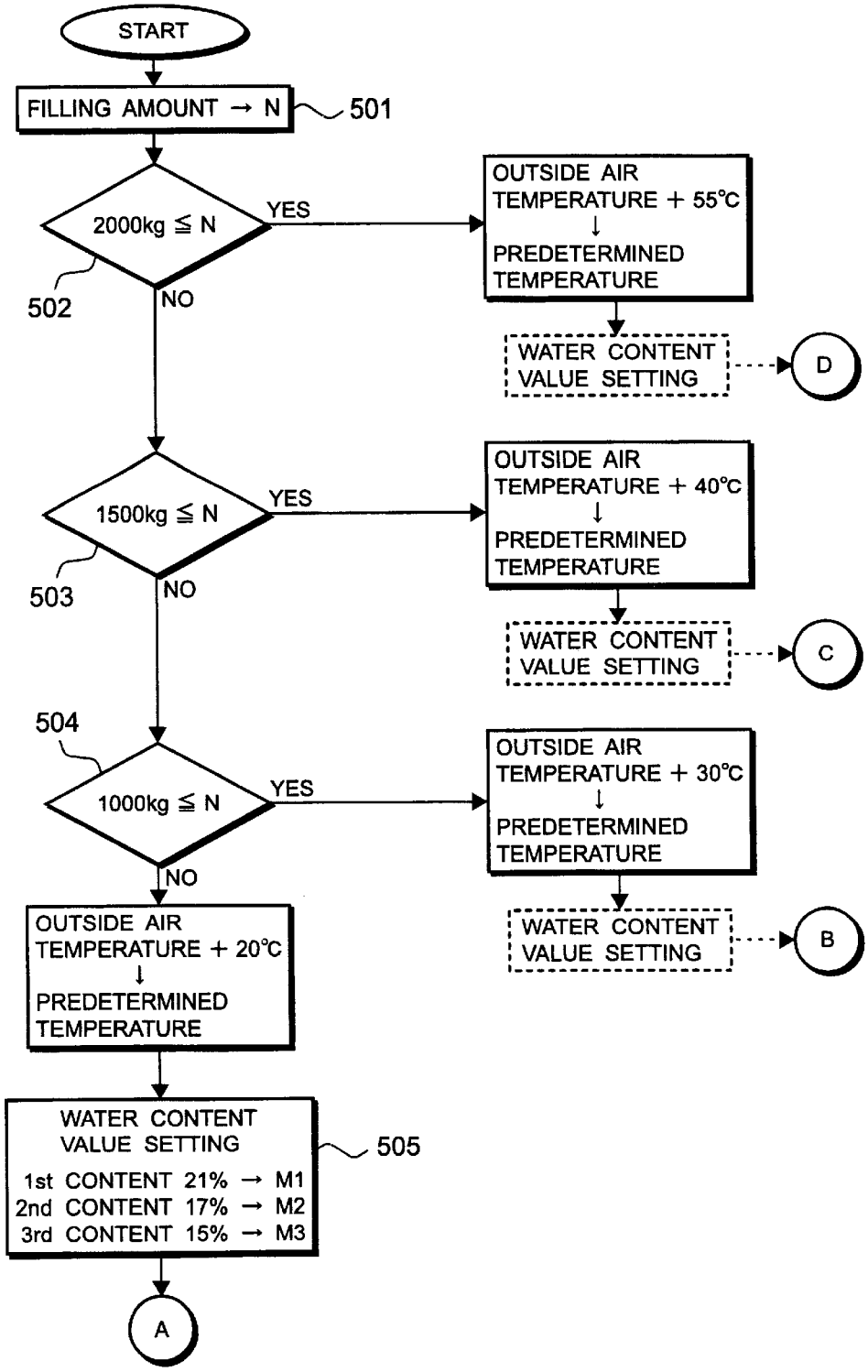
FIG. 5 is a flow-chart of the control means for setting the predetermined temperature based on the filling amount of the grains.

As shown in FIG. 5, at the starting of the drying operation, the amount N of the filling in the holding tank 2 is stored in the RAM 22*d* in the step 501. Some initial predetermined temperatures set against the filling amounts N have been stored in the ROM 22*c* in advance so that the predetermined temperature corresponding to the filling amount N at present is selected and then stored in the RAM 22*d*. More specifically, at the step 502, if the filling amount N is judged as being above 2000 kg, the outside temperature +55° C. against the outside temperature detected by the outside air temperature sensor 41 is stored as the initial predetermined temperature. At the step 503, if the filling amount N is judged as being below 2000 kg but above 1500 kg, the outside temperature +40° C. is stored as the initial predetermined temperature. Similarly, at the step 504, if the filling amount N is judged as being below 1500 kg but above 1000 kg, the outside temperature +30° C. is stored as the initial predetermined temperature. At the step 504, if the same is judged as being below 1000 kg (but above the minimum filling amount), the outside temperature +20° C. is stored as the initial predetermined temperature. Here, an example (A) is shown and explained hereunder in the case where the outside temperature +20° C. is used as the initial predetermined temperature. With respect to other examples (B) to (D), such a temperature as shown in the Table 1 is added to the outside air temperature detected by the outside air temperature sensor 41 and the resulting temperature is used as the initial predetermined temperature $T_0$.

TABLE 1

| PREDETERMINED TEMPERATURE (° C.) | | | | |
|---|---|---|---|---|
| | | MEASURED WATER CONTENT | | |
| FILLING AMOUNT (kg) | | 21% | 17% | 15% |
| (D) | 2000 | +55 | +30 | +10 |
| (C) | 1500 | +40 | +15 | +10 |
| (B) | 1000 | +30 | +15 | +5 |
| (A) | below 1000 | +20 | +7 | +5 |

Figure 6:
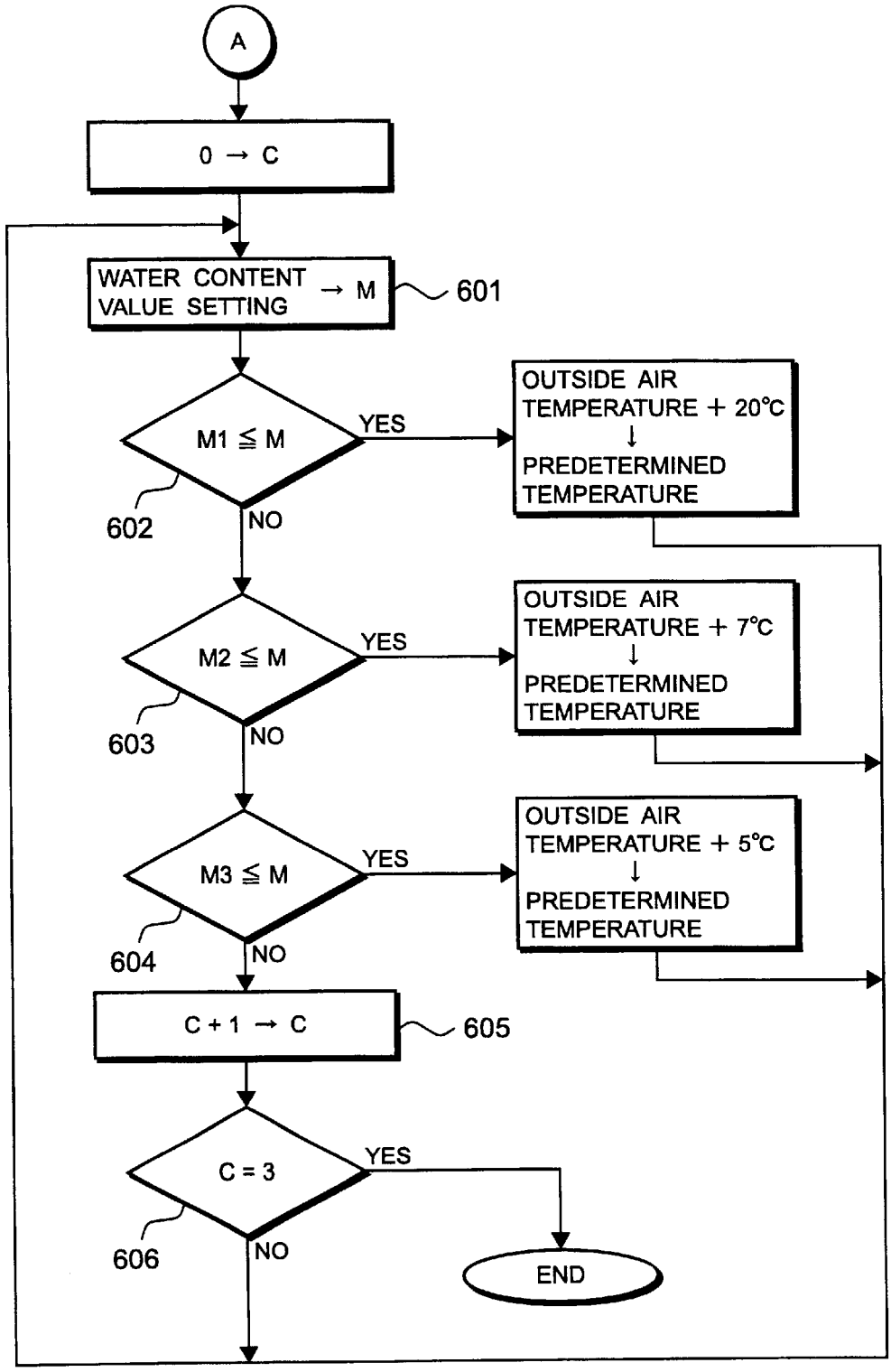
FIG. 6 is a flow-chart of the control means for changing the predetermined temperature based on the water content value of the grains.

The drying starts with the initial predetermined temperature being determined as the heated air temperature, but it is so arranged that, as the drying of the grains progresses, the predetermined temperature is caused to be dropped according to the dropping value of the water content of the grains. The water content values and the temperatures are stored in advance in the ROM 22*c* so that, while the water content of the grains is being measured during the drying, the predetermined temperature is caused to fall according to the change in the actual values of water content. Therefore, the values to be selected according to the filling amount N are the first to third water content values for changing the predetermined temperature (outside air temperature +20° C.) and the predetermined temperature shown in the step 505 as well as the predetermined temperature (outside air temperature +α° C.) for making a corresponding change when the water content value is that as shown in FIG. 6, and these values are read-out from the ROM 22*c* and stored in the RAM 22*d*. Here, the water content value which corresponds to the third water content value may be made as the finishing water content value which is inputted from the input section 29 and stored in the RAM 22*c*. In this case, the value stored in the ROM 22*c* is tentatively 15% but, when the third water content value read-out from the ROM 22*c* to the RAM 22*d* and the finishing water content value inputted from the input section 29 are compared, and the resulting value is different from the above percentage, the finishing water content value inputted from the input section 29 will have priority and replace the tentative percentage, and this value is stored in the RAM 22*d* as the third water content value.

As above, when the predetermined temperature is set according to the filling amount N from the start of the drying operation, the control as shown in FIG. 6 takes place according to the predetermined temperature thus set. First, the counter value at the RAM 22*d* is reset to "0". The signal from the water content detection means 18 obtained through the I/O port 22*a* is measured periodically with an interval of, for example, 10 minutes in the step 601, and the grain water content value M is compared with the first water content value of 21% in the step 602. As a result, if the grain water content value M is above 21%, the predetermined temperature $T_0$ stored in the RAM 22*d* of the control means 22, the outside air temperature +20° C. is maintained as it is. Further, if the grain water content value M is judged as being below 21% but above 17% in the step 603, the predetermined temperature $T_0$ stored in the RAM 22*d* of the control means 22 is changed to the outside temperature +7° C. Also, if the grain water content value M is judged as being below 17% but above 15% in the step 604, the predetermined temperature $T_0$ stored in the RAM 22*d* of the control means 22 is changed to the outside temperature +5° C. accordingly.

When the water content value is judged as being below 15% in the step 604, the counter set in the RAM 22*d* prior to the water content detection in the step 601 is incremented by "1" in the step 605, and the water content detection is again repeated in the step 601. In this way, since the predetermined temperature $T_0$ is changed every time the grain water content value changes, the drying operation can be carried out at the optimum drying air temperature for the grains according to the grain water content value. Finally, at the step 606, if the value of below 15% is detected three times, it is judged that the drying has been completed and the necessary operation ends. At the ending, the stop signal is sent to the burner means 14 from the control means 22. And, after a predetermined delay time, a signal is sent to the motor driving circuit 25 for stopping the motor 25*b* of the taking-out section 10 and, also after a further predetermined delay time, a signal is sent to the motor driving circuit 25 for stopping the bucket-elevator motor 25*c* and the fan motor 25*a*. Further, the water content values, the predetermined temperatures, the timing for the ending of drying, the intervals for the setting of water content, etc. set in the programs may be freely changed according to districts and/or conditions at or in which the drying apparatus for the grains is used.

Figure 7:
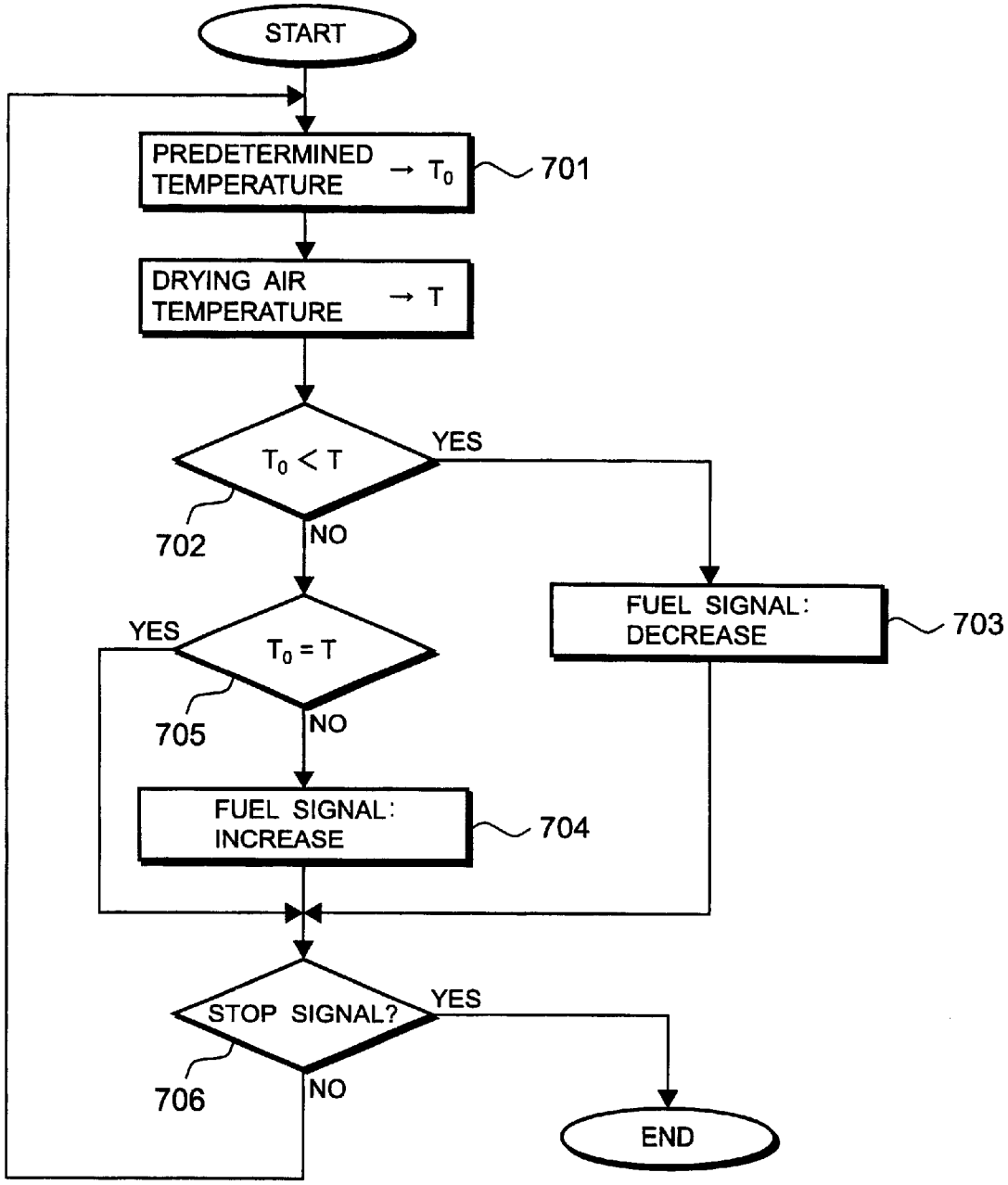
FIG. 7 is a flow-chart of the control means for controlling the burner means.

Next, with reference to FIG. 7, how the burner means 14 is controlled based on the temperature detected by the temperature sensor 21 is explained. In the ROM 22*c* of the control means 22, there is stored a control flow as shown in FIG. 7. By using as reference the predetermined temperature $T_0$ stored in the RAM 22*d* in the step 701 described above, the comparison is made with respect to the drying air temperature T detected by the temperature detection sensor 21 in the step 702 and, if the drying air temperature T is higher than the predetermined temperature $T_0$, a signal is sent from the control means 22 for decreasing the amount of fuel supply to the burner means 14 in the step 703. To the contrary, when the drying air temperature T is lower than the predetermined temperature $T_0$, a signal is sent from the control means 22 for increasing the amount of fuel supply to the burner means 14 in the step 704. When coincidence of the drying air temperature T with the predetermined temperature $T_0$ is detected in the step 705, no signal is sent out, and the detection of the drying air temperature T is repeated. This control is stopped, at the step 706, by the stopping signal generated in the control means 22 described above.

Figure 8:
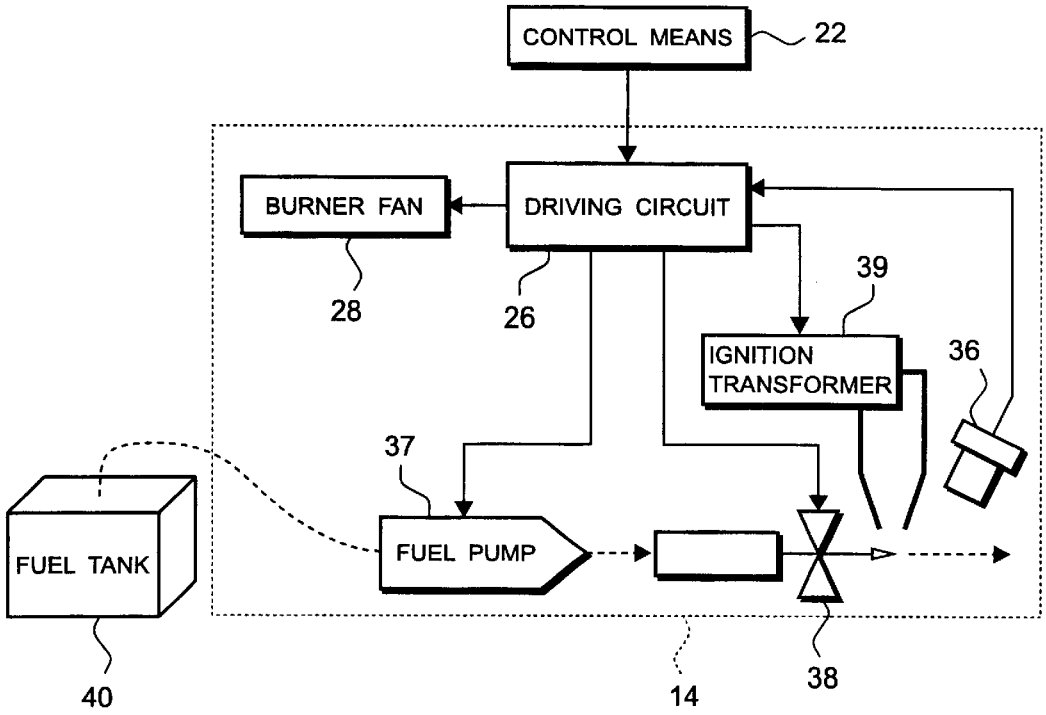
FIG. 8 is a block diagram of the burner means.

The signals generated according to the control flow of FIG. 7 are sent to the driving circuit 26 of the burner means 14 shown in FIG. 8 through the I/O port 22*a* of the control means 22. As shown in FIG. 8, the burner means 14 includes the driving circuit 26 as a main or central component. To the driving circuit 26, there are connected, a burner fan 28, an optical detection element 36, a fuel pump 37, an opening and shutting valve (hereinafter referred to as "valve") 38, and an ignition transformer 39. On receiving a signal from the control means 22, the driving circuit 26 drives the burner fan 28, and causes the fuel pump 37, the valve 38 and the ignition transformer 39 to act. The fuel pump 37 connected to a fuel tank 40 functions such that a constant amount of the fuel is continually supplied from the fuel tank 40 to the valve 38 and, by changing the opening and shutting time of the valve 38 through the driving circuit 26, the amount of fuel ejection is increased or decreased accordingly. In the vicinity of the valve 38, a pair of opposing electrodes connected to the ignition transformer 39 are provided, so that the fuel ejected by the opening and shutting operation of the valve 38 is ignited and burns. The burner fan 28, by its blowing action, blows out the heated air produced by the burning. In the driving circuit 26, it is possible to incorporate therein a logic circuit which causes the various elements to be operative or inoperative and the valve 38 to be opened or closed according to the signals inputted from the control means 22, or a CPU or a ROM may be incorporated in the driving circuit 26.

Figure 9:
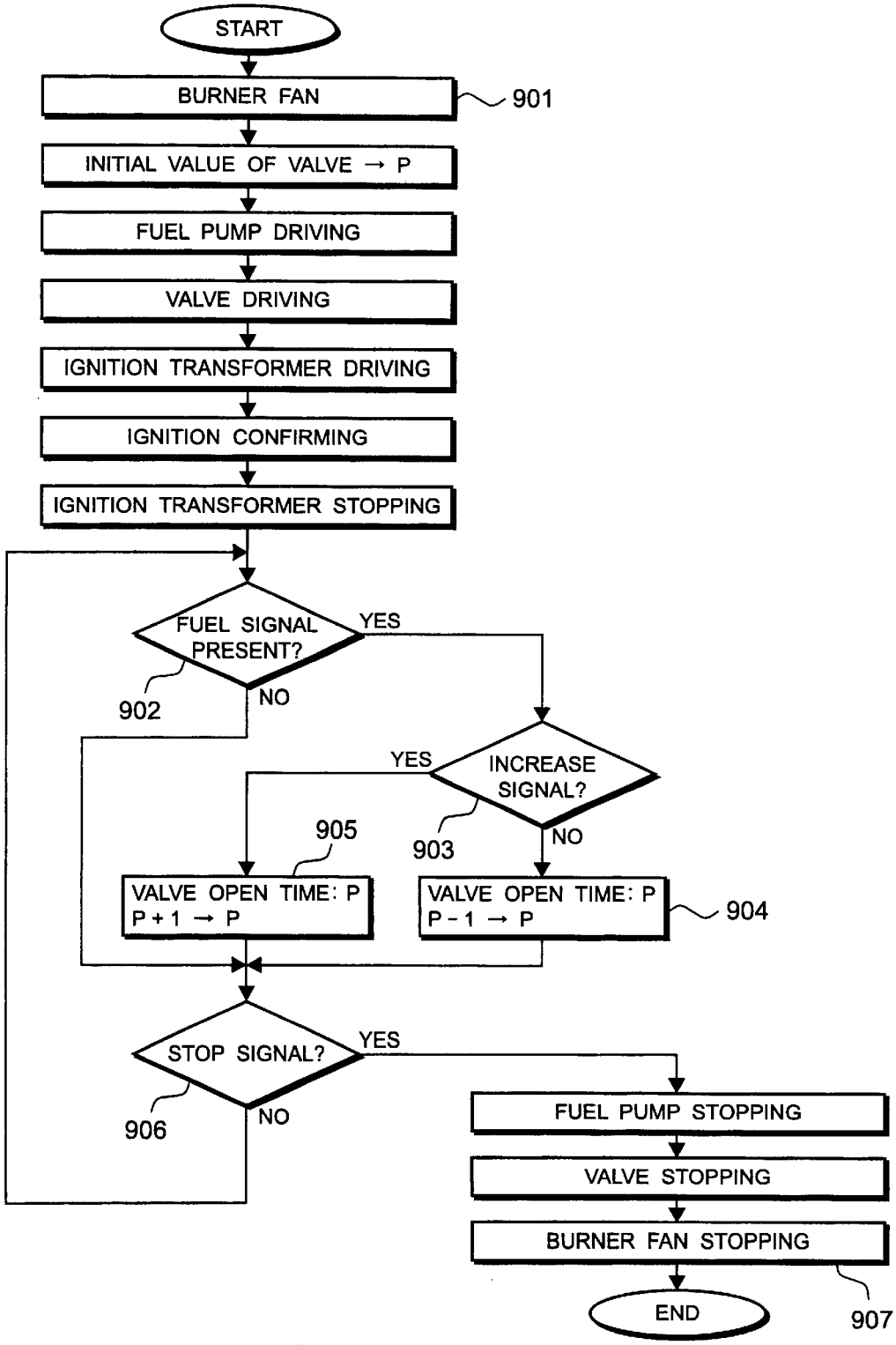
FIG. 9 is a flow-chart for the control of the burner means.

The burning in the burner means 14 proceeds according to the control flow which is as shown in FIG. 9 and which is incorporated or programmed in the driving circuit 26. In the burner means 14, upon receiving the signal from the control means 22, in the step 901, the burner fan 28 is driven according to the logic incorporated in the driving circuit 26, the fuel pump 37 is driven with the initial value P of the valve, the valve 38 is driven for opening and shutting at the initial value P, and the ignition transformer 39 is driven to ignite. Once the ignition is confirmed by the optical detection element 36, the operation of the ignition transformer 39 is stopped. When a signal for the fuel decrease or increase is received from the control means 22 in the step 902 after the burner means 14 is ignited as above, the signal for the fuel is judged as to which is of increase or decrease in the step 903. In the case of the decrease, the amount of fuel is decreased by shortening the opening time P of the valve 38 in the step 904. In the valve 38, the opening time P (for example, P=40 ms) of the valve per a unit time may be made short in a stepwise manner by 2 ms per step, thus lowering the heated air temperature by decreasing the amount of burning fuel.

Also, in the burner means 14, if the fuel signal for the increase or decrease of the fuel is judged as an increase signal in the step 903, the opening time P for the valve 38 is increased and the amount of the fuel ejection is increased in the step 905. The heated air temperature may be raised by increasing the amount of fuel supply by increasing the opening time P (=40 ms, for example) of the valve 38 per a unit time by 2 ms per step. In the burner means 14, in the step 906, determination as to whether the stopping signal generated in the control means 22, for example, the drying ending signal, exists or not. If the existence of the stopping signal is detected, the operation of the fuel pump 37 as well as the valve 38 is stopped and, after a lapse of a predetermined delay time, the burner fan 28 is stopped in the step 907, thereby completing the full stop of the burner means 14. The range (1 step) of the increase and decrease in the opening time of the valve 38 may be set to any desired value.

Referring back to FIGS. 1 to 3, the flow of the heated air and the drying air in the structure described above is explained hereunder. By the action of the burner means 14 and the suction of the air exhausting fan 20, the heated air produced by the burner means 14 becomes, for example, 100° C. and is directly introduced into the air ducts 12 of the heating section 13 and, thus, the air ducts 12 are heated by the introduced heated air. The heated air passing through the heating section 13 is introduced into the rear air path 16 and, by the suction of the air exhausting fan 20, the outside air taken-in from the outside air intake hole 17 is mixed in the heated air, and the resulting air becomes the drying air whose temperature is in the order of 40° C. This drying air is then introduced into the air paths 3 from the rear air path 16 and, while passing through from the air paths 3 to the air exhaust path 4, the drying air takes away the water content of the grains which flow down through the grain flow tubes 5. The water content taken away passes through the air exhaust path 4 and is exhausted to the outside of the apparatus 1 by the exhausting fan 20.

While the grains flow down from the holding tank 2 to the drying chamber 7, they are heated by being in contact directly with the air ducts 12 at the heating section 13 arranged between the holding tank 2 and the drying chamber 7. The grains thus heated are in turn exposed to the drying air and the water content is taken away while flowing down through the grain flow tubes 5 of the drying chamber 7, and the dried grains are then discharged from the drying chamber 7 by the operation of the rotary valve 8 of the taking-out section 10. The grains discharged are laterally conveyed by the screw conveyer 9 and then fed back to the holding tank 2 by the bucket elevator 11. In this way, the grains are circulated through the series path of the holding tank 2, the heating section 13, the drying chamber 7, and the taking-out section 10 until the set water content value is reached.

As already explained, it is arranged that the outside air is introduced from the outside air intake hole 17 disposed after the heating section 13 so that the heated air produced by the burner means 14 and introduced into the air ducts 12 can be elevated to the temperature in the order of 100° C. independently from the temperature required for the drying air. Thus, since the temperature of the air ducts 12 of the heating section 13 can be raised sufficiently high, the temperature of the grains flowing down through the air ducts 12 and being in contact therewith can be not only heated up to a suitable high temperature, but also the heated air, even being a high temperature, can be adjusted to a suitably low drying air temperature since the high temperature heated air can be mixed with the outside air. That is, at the heating section 13, the air may be heated up sufficiently without taking the temperature of the drying air into account.

Here, the temperature of the grains is considered. The temperature inside the grain heated at the heating section is such that the temperature at the center portion of the grain and the temperature at the surface portion thereof become uniform. As a result, because there is no distortion in terms of temperature between the center portion and the surface portion of the grain, such defects as a crack will not occur in the grain and the water content thereof is easily and safely taken away by being exposed to the drying air in the drying chamber 7. The temperature of the drying air in the drying chamber 7 is lowered in accordance with the decrease in the water content value of the grains. The range of the variable temperatures for the drying air is between 40° C. and 30° C., for example.

Although the above explanation has been made such that the drying air flows from the air paths 3 to the air exhaust path 4 through the grain flow tubes 5, the connection of the rear air path 16 and the air exhausting fan 20 to other components may well be changed so that the air flows from the air exhaust path 4 to the air paths 3 through the grain flow tubes 5. Importance here is that the grains having been heated at the heating section 13 are exposed to the drying air which is produced by the introduction of the outside air into the heated air forwarded from the heating section 14. Thus, the flow of the drying air is not limited to the illustrated embodiment.

Figure 10:
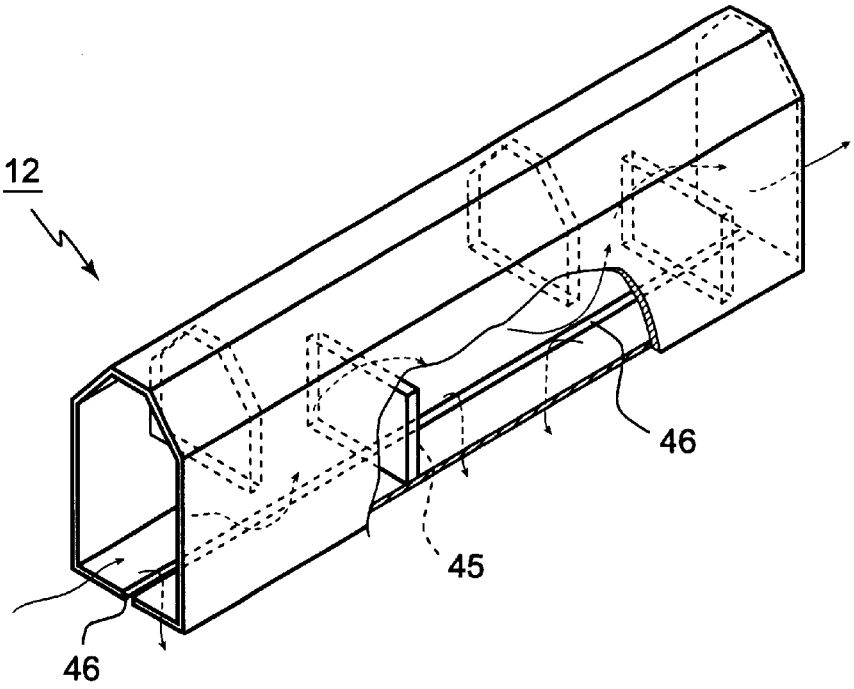
FIG. 10 is an enlarged perspective view for showing the internal structure of the air duct.
Figure 11:
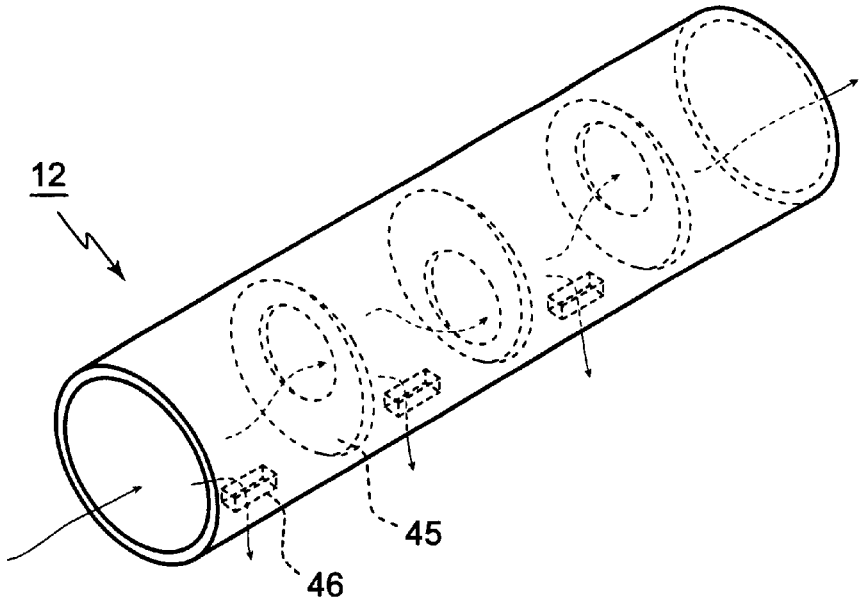
FIG. 11 is an enlarged perspective view for showing the internal structure of another example of the air duct.

As shown in FIG. 10, on the inner wall of the air duct 12 of the heating section 13, there are provided a plurality of resistance plates 45 for causing the flow of the heated air to be in a zigzag fashion. The sectional shape of the air duct 12 and the shape of the resistance plate 45 are not limitative to those shown in FIG. 10. Specifically, the sectional shape of the air duct 12 may well be as shown in FIG. 11 so long as it causes the grains to flow smoothly and evenly. The shape of the resistance plate 45 may well be any one so long as the entire air duct 12 is uniformly heated.

It is preferable that the air duct 12 at the heating section 13 is provided with air jet openings (holes or slots) 46 for jetting out a part of the heated air (in the order of 1% of the heated air). A part of the heated air is directly jetted into the flow of the grains from the jet openings 46 of the air ducts 12, whereby the temperature of the grains is further elevated. If the temperature of the heated air is in the order of 80° C. to 100° C., the circumference temperature becomes a temperature in the order of 50° C. to 70° C. by the heating by the air ducts 12 and the heated air jetted from the jet openings 46. Though an adverse influence on the grains by the jetted heat air may be thought of, as there occurs only small movement of the air in this heating section 13 unlike in the drying chamber 7, the jetted heated air causes only the temperature of the grains to be elevated and no drying operation occurs here. Therefore, no defect such as a crack caused by the rapid drying occurs.

Further, as already explained, a part of the heated air ejected from the jetting hole or slot 46 towards the flowing down grains results in the raising of the temperature of grains adjacent the air ducts 12 while the grains flow down to the drying chamber 7. Thus, the substantive drying including the raising of the grain temperature is effected also in between the heating section 13 and also the drying chamber 7. This means that the effect is the same as that obtained by enlarging the drying chamber 7. Moreover, although the drying chamber becomes larger, the heating section 13 is provided in the holding tank 2, so that there is no increase in the overall structure of the holding tank 2 and the drying chamber 7. In other words, since there is no increase in the size of the apparatus despite the substantial increase in the size of the drying chamber 7, the arrangement enables the decrease of the drying apparatus in substance and, more over, enables the realization of the faster drying.

Figure 12:
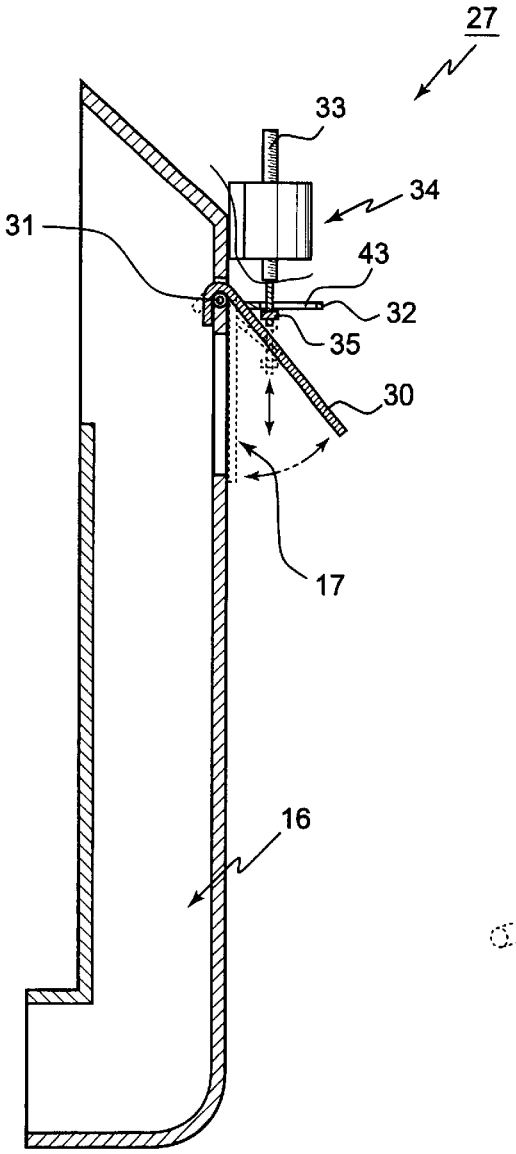
FIG. 12 is an enlarged sectional view showing the outside air intake means.
Figure 13:
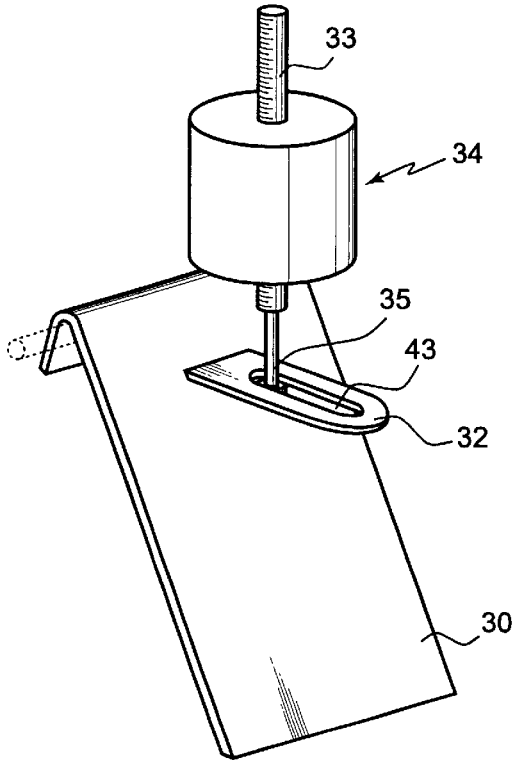
FIG. 13 is a perspective view showing the detail of the outside air intake means.

Now, with reference to FIGS. 12 and 13, an outside air adjusting means, that is, an opening and shutting means 27 for an outside air intake hole 17 is explained. An opening and shutting plate 30 is rotatably mounted on an axis 31 for allowing the plate 30 to be freely opened and shut. On the plate 30, an arm 32 is provided, and in the vicinity of the arm 32, there is provided a motor 34 for allowing a shaft 33 thereof to be driven upwardly and downwardly. The shaft 33 carries a supporting member 35 which passes through a slot 43 formed in the supporting arm 32. The motor 34 drives the supporting member 35 for upward and downward movements so that the arm 32 moves upwardly and downwardly, and by the action of the arm 32 the opening and shutting plate 30 is operated so as to open or shut the outside air intake hole 17.

A further explanation is made here for the function of the outside air intake hole 17 operated by the opening and shutting means 27. The opening area of the outside air intake hole 17 is required to be just sufficient to maintain the amount of air to compensate the amount of suction air of the air exhausting fan 20. The basic operation is to fix the opening area in a constant size and, for doing so, the opening and shutting means 27 for the outside air intake hole 17 is operated so that the total air amount of the amount of output air from the air ducts 12 of the heating section 13 and the amount of absorbed air from the outside air intake hole 17 becomes approximately the same as the amount of the air sucked by the air exhausting fan 20. This basic opening area is set in advance so that the opening and shutting means 27 is normally not operated.

However, the opening and shutting means 27 is operated in the following case. That is, in order to raise the drying grain temperature speedily in preparing for the drying at the initial stage where the water content is high or during the stage wherein the filling takes place, it is more effective to raise the temperature of the grains by causing them to be in contact with the heated air than to expose them to a large volume of drying air and, for this reason, the outside air intake hole opening and shutting means 27 is operated to rotate the opening and shutting plate 30 so as to shut the outside air intake hole 17. In this way, the amount of the air introduced from the outside air intake hole 17 becomes short, and this shortage in the amount of air is compensated by introducing into the grains the heated air in the air ducts 12 from the air jet holes or slots 46 provided in the walls of the air ducts 12. That is, as already explained, into the grains flowing down, the heated air leaks from the heating section 13 and enhances the heating of the surrounding grains. This step is only to raise the grain temperature quickly, and this heated air does not act on the grains for a long period of time. An appropriate time period is for one to two cycles of the grains introduced. It is possible to incorporate in the program of the control means 22 the step by which the opening area of the outside air intake hole 17 is narrowed only by the time period of the above one to two cycles according to the filling amount inputted in the control means 22 at the initial stage of the drying. In this way, the related operations may simply be automated, but of course the operations may be manually carried out.

When the drying signal is inputted from the input section 29 to the control means 22, in addition to the operation to control the drying as explained above, a signal is outputted to the motor driving circuit 25 so that the air opening and shutting motor 34 is operated to close the outside air intake hole 17. This signal may be programmed either to be outputted simultaneously with the inputting of the signal for drying, or to be outputted upon the detection of water content value by the water content detection means 18 as being, for example, above 20%, thus the air opening and shutting motor 34 starts to be operated.

As clarified in the foregoing, an advantageous effect of the invention resides in the arrangement that, in line with the trend of making the size of the drying apparatus smaller, the heated air for heating and the drying air for drying are communicated in the same air passage, and the drying air is produced by mixing the introduced outside air with the heated air, thus enabling the maintenance of a high temperature of the heated air for pre-heating.

Irrespective of the temperature of the heated air for pre-heating, it is possible to set the drying air to a predetermined temperature which, with the effect of the pre-heating, makes it possible to carry out the safe and speedy drying. Also, because the heating section at which the pre-heating is effected is provided in the holding tank, it is not necessary to provide a separate or additional space for the heating unlike the case where the far infrared radiation apparatus is used.

Since a part of the heated air is allowed to be in contact directly with the granular objects, the heating is efficiently effected without giving damages to the granular objects, and it is possible to achieve the fast raising of the temperature of both the surface portion and the inside of the granular objects, thus enabling the speedy drying operation.

Since the amount of the outside air introduced can be adjusted, it is possible to control the amount of a part of the heated air directly supplied to the granular objects at the heating section, and to adjust the speed of the heating, thus enabling the change in the amount of heated air introduced depending on the granular objects. Thus, the heating can cope with many different kinds of granular objects.

While the invention has been described in its preferred embodiments, it is to be understood that the words which have been used are words of description rather than limitation and that changes within the purview of the appended claims may be made without departing from the true scope of the invention as defined by the claims.

What is claimed is:

1. An apparatus for drying granular objects until their water content reaches a predetermined water content value, said apparatus comprising:

a holding means for holding therein the granular objects;

a heated air generating means for generating a heated air;

a pre-heating means for heating the granular objects flowing down from said holding means, said pre-heating means being provided beneath said holding means and having a plurality of air ducts horizontally arranged therein, the heated air generated by said heated air generating means being introduced to each of one ends of said plurality of air ducts;

a drying air producing means connected to the other ends of said plurality of air ducts, in which the heated air from said air ducts is mixed with air taken-in from the outside of the apparatus so as to produce a drying air;

a drying means for drying the granular objects by directly exposing the granular objects to said drying air, said drying means having a drying chamber to which the granular objects after having been pre-heated at said pre-heating means are supplied and to one end of which the drying air produced by said drying air producing means is introduced;

an exhausting means connected to the other end of said drying chamber of said drying means, for exhausting the drying air involving humidity to the outside of the apparatus; and a taking-out means arranged beneath said drying means, for taking out the dried granular objects.

2. An apparatus for drying granular objects according to claim 1, said apparatus further comprising a feed-back means for feeding-back the granular objects taken out from said taking-out means to said holding means.

3. An apparatus for drying granular objects according to claim 1, said apparatus further comprising a temperature detection means for detecting a temperature of said drying air produced by said drying air producing means and a control means connected to said temperature detection means, said control means controlling said heated air generating means based on the temperature value detected by said temperature detection means so that a temperature of said drying air produced by said drying air producing means is kept at a predetermined value.

4. An apparatus for drying granular objects according to claim 1, in which each of said air ducts of said pre-heating means has a plurality of resistance plates therein for causing the flow of the heated air therein to be in a zigzag fashion.

5. An apparatus for drying granular objects according to claim 1, in which each of said air ducts of said pre-heating means has a plurality of openings for jetting a part of said introduced heated air to the outside of said air duct.

6. An apparatus for drying granular objects according to claim 1, in which said drying air producing means comprises an outside air adjusting means for adjusting an amount of outside air taken-in from the outside of the apparatus.

* * * * *